United States Patent [19]

Plikuhn

[11] Patent Number: 4,522,006

[45] Date of Patent: Jun. 11, 1985

[54] DRUM AND DRUM BODY FORMED FROM ADHERED, SOLID BLOCKS OF WOOD

[76] Inventor: Keith A. Plikuhn, 6618 S. Richmond St., Chicago, Ill. 60629

[21] Appl. No.: 503,691

[22] Filed: Jun. 13, 1983

[51] Int. Cl.[3] ..... E04C 1/30; B27F 7/00

[52] U.S. Cl. ..... 52/585; 52/233; 52/245; 144/350; 144/353

[58] Field of Search ..... 144/345, 346, 350, 353; 52/233, 245, 585

[56] References Cited

U.S. PATENT DOCUMENTS

| | | | |
|---|---|---|---|
| 2,062,175 | 11/1936 | Hartman | 144/351 |
| 2,218,288 | 10/1940 | Long | 144/353 |
| 3,788,372 | 1/1974 | Terenzoni | 144/350 |

*Primary Examiner*—W. D. Bray

[57] ABSTRACT

A drum with a body composed of solid wood blocks glued together. The blocks form a cylinder which constitutes the drum body with each block extending the entire thickness of the cylinder wall. The blocks lie in circular layers with each layer having a staggered orientation relative to its adjacent layers. Dowels pass through the blocks to provide greater support to the body. The upper and lower edges of the cylinder have a recessed configuration relative to the body's outer surface to provide a floating drum head. To produce the drum body, each block in a layer has its ends tapered toward the middle of the block. Where each layer includes 16 blocks, the end faces of a block have an angle of 22.5° relative to each other. Gluing the blocks together forms a long cylinder having, however, rough external and internal surfaces. Milling on both the outside and the inside of the cylinder provides smooth surfaces of a pleasing appearance. Drilling holes through the length of the cylinder allows for the placement of the dowels, also then glued to the blocks. Slicing the cylinder into sections produces several drum bodies which then have their edges finished to a sharp ridge to support the drum head.

34 Claims, 8 Drawing Figures

FIG. 1
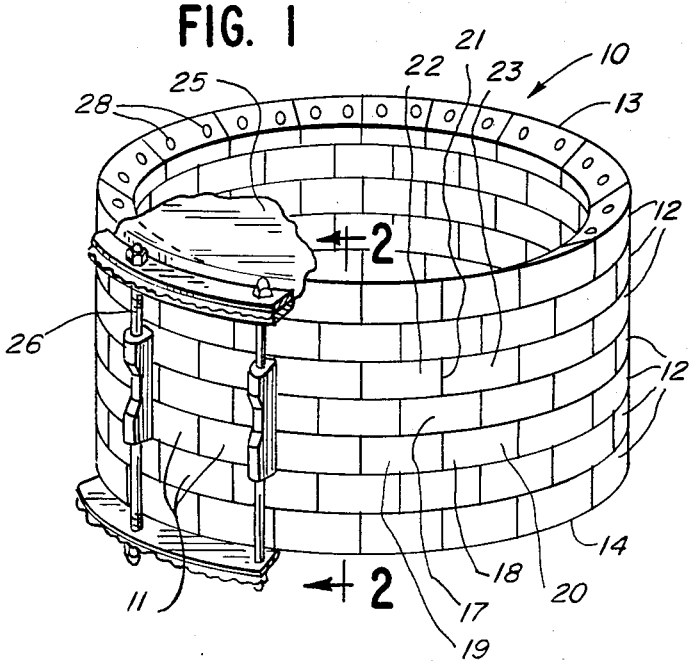
FIG. 2
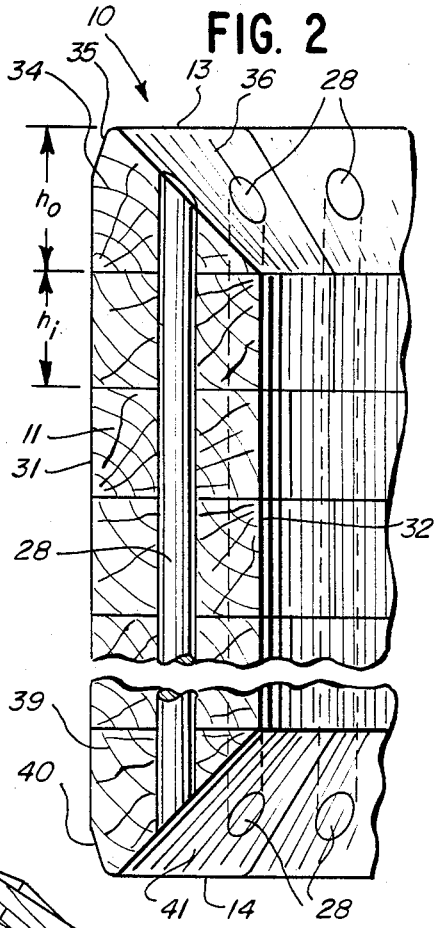
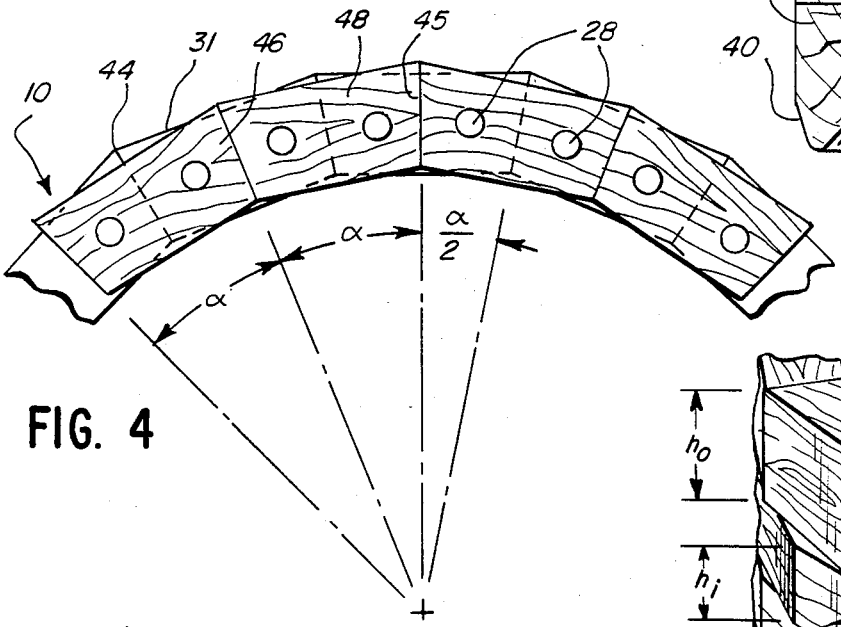
FIG. 4
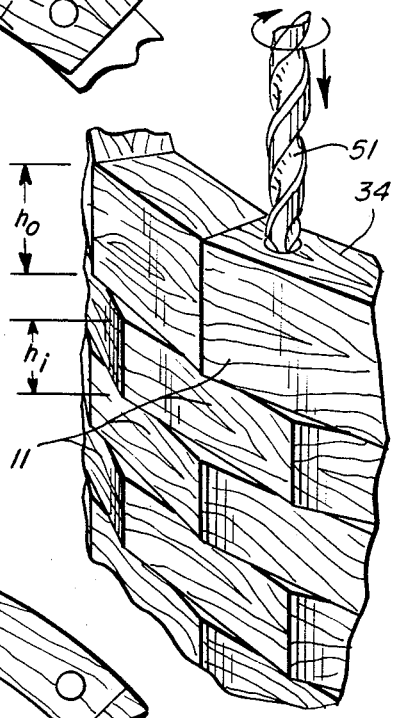
FIG. 3
FIG. 5
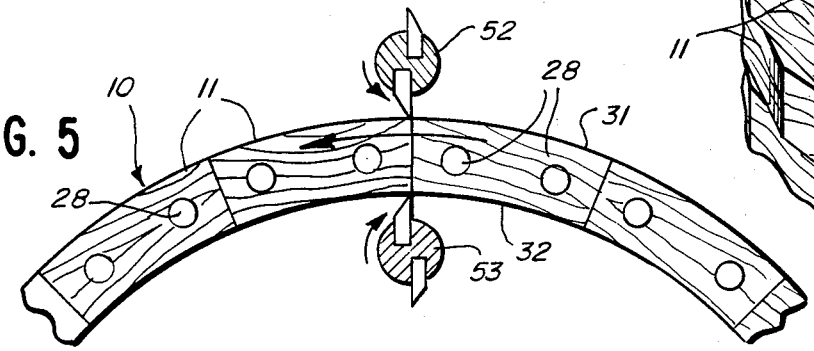

DRUM AND DRUM BODY FORMED FROM ADHERED, SOLID BLOCKS OF WOOD

BACKGROUND

Drum bodies provide a resonant cavity for the vibrations initiated by the stick hitting the head. Thus, the sound produced depends upon the quality of the body's construction. In the case of snare drums, the body determines the nature of the vibrations passing to the head and the snares on the lower side and thus the quality of their tone as well.

Many drum bodies currently have a construction of plywood. Typically, the material includes five to seven thin plies of wood glued together with their grains running in crossing directions. Bending the plywood then forms the circular configuration of the body.

Shaping the plywood, however, places it under stress. As a result, it displays a lower capacity for transmitting vibrations and thus reduces the desired tone from the drum. It also shows a propensity for interferring with the passage of vibrations from the upper to the lower head of a snare drum.

Furthermore, the glue between the plywood layers also has a tendency to absorb and dampen vibrations from the heads. In particular, the glue also appears at the upper and lower edges upon which rest the heads. This direct contact between the heads and the glues also destroys vibrations that could create the desired tone.

In addition, the grain in the several layers of the plywood run at crossing directions. Thus, a strong attack on the drum head creates vibrations in the separate layers which can, in fact, cancel each other. Furthermore, plywood, when placed under the pressure of the heads, can change its shape. This change in shape causes the body to lose some of its capability to transfer and transmit vibrations. Especially do drum bodies losing their shape suffer in their capability of properly transmitting the vibrations for loud tones.

As an alternative to plywood for bodies, other drum manufacturers utilize metal. However, metal can also lose its round shape if the player tightens the drum head in a circle. Again, the transmission of vibrations suffers. Accordingly, the player must take care to tighten points on opposite sides of the drum in an effort to keep it from losing its desired round shape.

Furthermore, wood produces a warmer tone than metal. As a result, drum bodies made of metal do not satisfy many discerning ears.

In addition, presently available drum bodies have only a limited "sweet" area which gives a desired sound when contacted with the drumstick and properly affects the snares when present. The player, accordingly, must take care not to hit the head outside of this area. Furthermore, the drum must undergo preparation for the specific type of playing, loud or soft, that the player intends. If set for loud, a light stroke does not produce an adequate tone or contact of the snares with the lower head. If set for soft, a hard stroke will cause the drum to "choke".

Thus, drum manufacturers have used various types of construction for drum bodies including those discussed above. However, each shows some drawbacks in use. Accordingly, the search for an improved drum body continues.

SUMMARY

Creating a drum body from solid wood blocks that pass from the outside to the inside of the drum avoids many of the problems of the prior bodies. It especially produces a most pleasing tone over a wide range of loudness.

To form the drum body, the solid wood blocks permanently adhere to each other to form a solid surface. The surface has the shape of a cylinder with two open ends. Each end of the cylinder defines a substantially flat plane.

Typically the outside, and usually the inside, has a substantially smooth surface. Furthermore, the two planes defining the ends of the drum body lie substantially parallel to each other.

To provide greater strength to the drum body, the blocks typically lie in layers. Further, the blocks in each layer have a staggered configuration relative to the blocks in adjacent layers.

Furthermore, dowels may pass through the cylinder's wall from one end to the other. These adhere to the blocks through which they pass with the aid of an adhesive.

Where the wood of each block sits into the cylinder in a nonstressed condition, the resulting drum body appears to have the greatest capability of passing the desired vibrations. For the blocks to thus fit together without bending, their ends must undergo cutting to provide faces that taper towards each other. In a layer containing sixteen blocks, the angle between the ends amounts to 22.5°. Ideally, the grain in each block lies in the plane determined by the layer which contains that block.

Producing the drum body involves adhering together a plurality of the solid wood blocks having substantially flat faces. When adhered together, the blocks form the solid surface in the shape of a cylinder with two open ends. Each of the blocks extends from the inside to the outside of the cylinder. The production of the drum bodies should also include the smoothing of the outer surface of the cylinder to produce a pleasing appearance and effect.

Typically, the adhering of the blocks to each other results in layers. The blocks of each layer have a staggered configuration relative to those in adjacent layers. Furthermore, the dowels, where used, generally enter the cylinder before the final smoothing of the outer surface. However, this represents a matter of convenience and may proceed afterward.

BRIEF DESCRIPTION OF THE FIGURES

FIG. 1 shows a drum body formed from solid blocks of wood adhered together.

FIG. 2 gives a cross-sectional view along the line 2—2 of the drum body shown in FIG. 1.

FIG. 3 illustrates the trapezoidal shape of the blocks forming the drum body as well as the placement of the dowels.

FIG. 4 shows the drilling of holes through the drum body for the placement of dowels.

FIG. 5 illustrates the smoothing of the inner and outer surfaces of the drum body.

DETAILED DESCRIPTION

Figure 6:
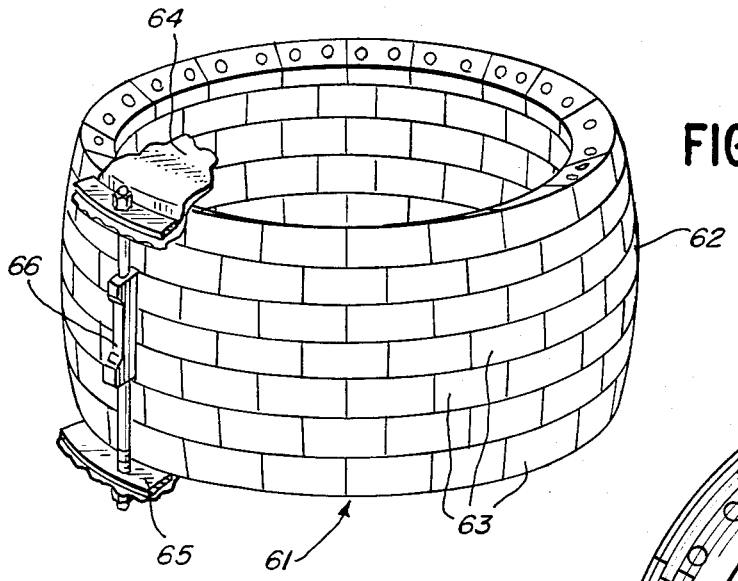
FIG. 6 gives a perspective view of a drum body having a bowed outer configuration.

The drum body shown generally at 10 in FIG. 1 includes the multiplicity of wood blocks 11 adhering together. The blocks 11 form rows 12 and give an overall appearance of a cylinder. The layers 12 each forms a plane having a parallel orientation relative to the upper and lower ends of the drum 13 and 14.

The blocks in any row 12 have a staggered orientation relative to the blocks in any adjacent. Thus, for example, the middle of the block 17 sits immediately on top of the juncture 18 of the two blocks 19 and 20 in the row below. Similarly the juncture 21 between the blocks 22 and 23 sits over the middle of the block 17 in the row below it.

To find use as a drum, the body 10 must also include the head 25 which the hardware 26 holds in a stretched condition over the end 13. As shown in FIG. 1, only the head 25 need touch the body 10. The hardware 26 only serves to keep the head 25, and a similar head on the bottom of the drum, in a stretched condition. It thus need not touch the wood of the body 10 at all.

As shown in FIGS. 1 and 2, the dowels 28 pass entirely through the drum body 10 from top to bottom. The latter figure shows that each of the blocks 11 passes all the way from the outer surface 31 to the inner surface 32 of the body 10. The dowels 28 then pass through approximately the center line of the blocks 11 while travelling from the upper end 13 to the lower end 14 of the drum.

The top layer of blocks 34 includes first the bevel 35 between the outer surface 31 and the very top 13. The bevel of the surface 35 forms an angle of about 22° relative to the outer surface 31. More precisely, one side of this angle results from the slope of the bevel 35 taken on the cross-sectional plane shown in FIG. 2. The angle has a precise measurement relative to the normal passing through the plane determined by the upper edge 13. The plane of the upper edge 13, as shown in the figures, lies parallel to the plane of the lower surface determined by the bottom edge 14, as usually represents the case for drums.

The bevel 35 serves to recess the upper edge 13 from the outer surface 31 of the drum body 10. This permits the vibrations in the drum body 10 to result from the contact between the drum head 25 and the body 10 without the interference or suppression from the metal 26 having contact with the wood.

The upper layer 34 also has the bevel 36 between the inner surface 32 and the upper edge 13. This bevel removes ancillary contact of the wood body 10 aside from the upper edge 13 with the head 25. The bevel 36, on the cross-sectional view of FIG. 2, makes an angle of 45° relative to the normal passing through the plane determined by the upper edge 13.

Similar remarks apply to the lowest row of blocks 39. It too has the outer bevel 40 and the inner bevel 41. These generally have the same angles as their counterparts, bevels 35 and 36, respectively. This allows the bottom edge 14 to similarly support the head on the bottom of the drum body 10. Naturally, where the drum body 10 does not have a lower drum head, the lower edge 14 may have a different configuration than that shown in FIG. 2.

Although, as shown in FIG. 1, the drum body 10 has a smooth, rounded outer surface, the construction commences with the utilization of blocks having only flat surfaces. Gluing these blocks together, as suggested in FIG. 3, results in the outer surface 31 having many sharp edges 44 at the juncture of two adjoining blocks. Subsequent milling will remove the rough edges to produce the smooth surface.

As seen in FIG. 2, the upper layer of blocks 34 has a greater height $h_o$ than the inner layers which have a height of $h_i$. This permits the milling of the bevels 35 and 36 and the resulting development of the edge 13 without cutting through any glued joints between adjacent layers 12. Similar remarks apply to the lower layer 39 which also has a greater height than the inner layers.

A block should typically remain in an unstressed condition as it forms part of the drum body 10. Yet, to form a solid drum body, the faces of adjoining blocks should make complete contact with each other. This requires the blocks, when viewed from above as shown in FIG. 3, to have a trapezoidal shape. Thus, the two end faces 45 and 46 of the particular block 48 do not lie parallel to each other. Rather, they describe the angle $\alpha$ between them which actually meets at the center C of the drum body 10. The angle $\alpha$ represents the number obtained from dividing 360° by the number of blocks in a layer describing a complete circle. Where, in particular, a layer has sixteen blocks, then the angle $\alpha$ amounts to 22.5°.

Placing unstressed blocks 11 into the body 10 results in their grain having their condition that they possessed in the natural state. Typically, that grain lies in the plane determined by the layer in which the block sits. The grain typically runs tangential to the cylindrical surface at the point at which the block has its location. Thus, the grain describes a similar pattern as do the blocks in the layer before their milling into a smooth surface.

Typically, the blocks 11 require some form of glue to hold them together. An aliphatic resin glue adequately provides that function without having an undue, deleterious effect upon the vibrations within the body 10.

After gluing the blocks 11 together, the dowels 28 may find use to provide additional strengthening. Not all drum bodies will require the dowels 28. However, they do provide additional reinforcement to the drum body 10 and may assist in passing the vibrations from one end to the other.

As shown in FIG. 4, the drill bit 51 makes the opening into the blocks 11 after they have adhered to each other through gluing. The bit 51 passes through the upper layer 34 and then into the remaining layers below. After the completion of the drilling, the dowels 28 enter the resulting openings. Gluing them with the aliphtic resin glue will keep the dowels 28 in place.

As shown in FIG. 3, a convenient arrangement places two dowels 28 through each block 11. With the staggered configuration discussed above, one of the dowels 28 in a particular block will also pass through one of the blocks that sits below and one of the blocks that sits above it. The other dowel will pass through the other block sitting below as well as the other block sitting above the particular one under consideration. Thus, the staggered configuration as well as the placement of the dowels 28 helps provide the drum body 10 with adequate lateral stability.

After the gluing of the dowels 28, the drum body 10 may undergo milling with the tools 52 and 53. The former provides the smooth outer surface 31 and the latter the smooth inner surface 32.

At this point, the process has produced a cylinder of blocks lying in layers with staggered orientation relative to adjoining layers. The cylinder has smooth inner and outer surfaces. In the manufacture, the cylinder may have a length substantially greater than the height of a single drum body. At this point, the cylinder may undergo cutting into segments to provide several drum bodies. This procedure facilitates the manufacture of several drum bodies at a single time and thus reduces the effort and cost for each.

After cutting the cylinder into segments, if required, the formation of the upper and lower edges 13 and 14 takes place. This merely involves milling the upper bevels 35 and 36 and the lower bevels 40 and 41. This completes the manufacture of a single drum body. At this point, it may undergo staining and oiling. Once this has dried, the addition of the drum head 25 with the brackets 26 completes the construction of a drum.

FIG. 6 shows a drum body 61 having a bowed outer surface 62 rather than the straight outer surface 31 of the prior figures. This alternative configuration simply gives the purchaser a choice as to the most aesthetically pleasing design. The production of the bowed drum body 61 may serve to merely involve the use of somewhat thicker blocks 63 and their subsequent milling into the bowed shape. Again, to produce the drum, the body 61 requires the heads 64 and 65 as well as the interconnecting metal bracket 66.

Figure 7:
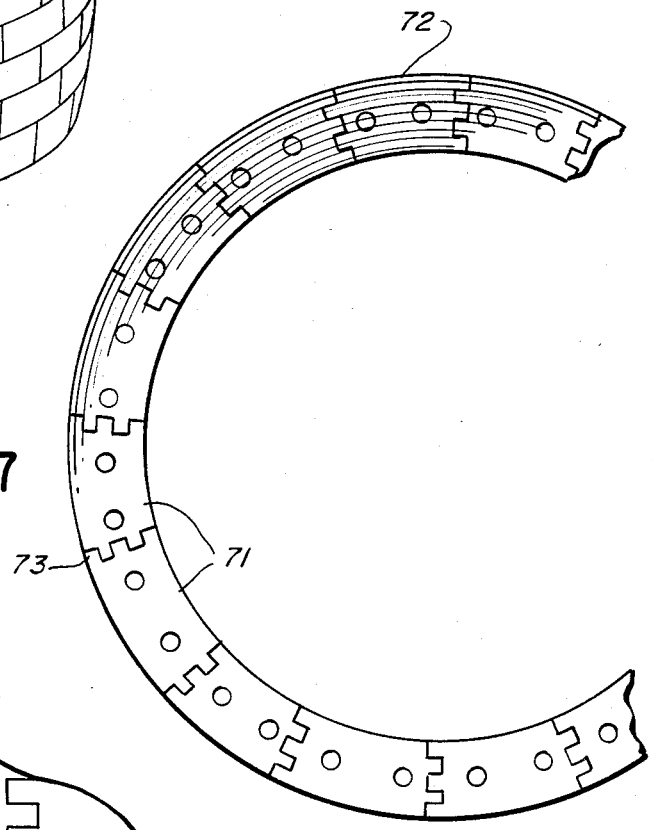
FIG. 7 gives a top plan view of a drum body in which adjacent blocks in a layer have vertically running box joints between them.

FIG. 7 shows adjacent blocks 71 within a single layer of the drum body 72. To provide greater stability, the blocks 71 have the vertically running box joint 73 between them.

Figure 8:
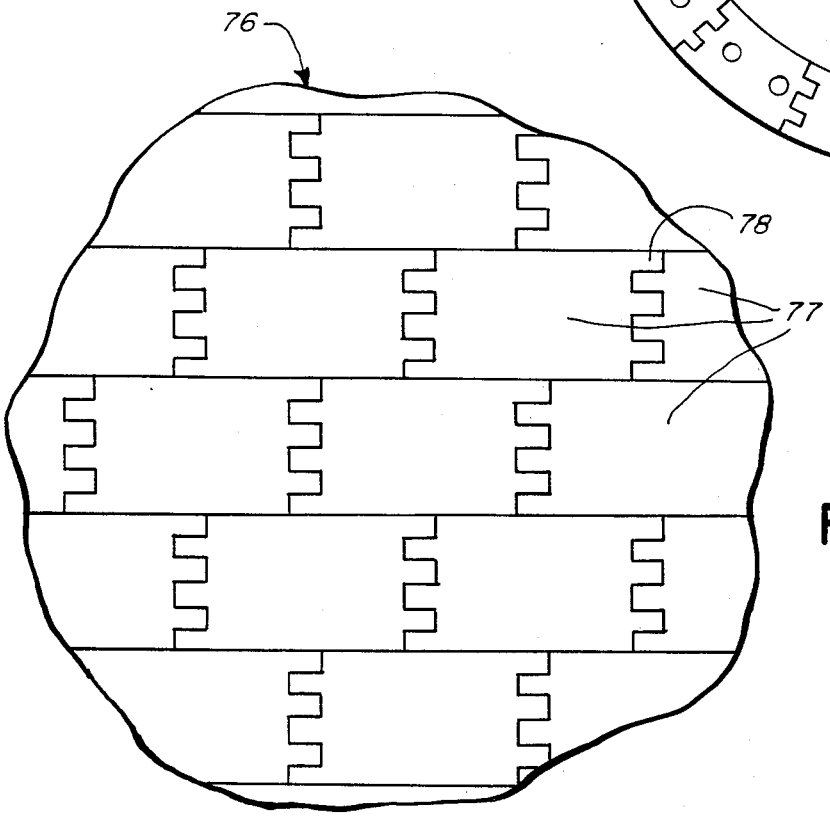
FIG. 8 shows a portion of a drum body in which adjacent blocks in a layer have horizontally running box joints between them.

FIG. 8 illustrates a portion of the exterior surface of an alternate drum body 76 showing the blocks 77 lying in several layers. Again, adjacent blocks 77 within a layer have the horizontally running box joint 78 running from the outer surface to the inner surface.

Accordingly, what is claimed is:

1. A drum comprising:

(A) a plurality of solid wood blocks permanently adhered to each other, said adhered blocks forming a solid surface having the shape of a cylinder with two open ends, each of said blocks extending from the inside to the outside of said cylinder, each of said two ends of said cylinder defining a substantially flat plane;

(B) a drum head in contact with one of said ends of said body; and (C) stretching means, coupled to said head, for retaining said head under pressure against said one end.

2. The drum of claim 1 wherein said outside of said cylinder has a substantially smooth surface.

3. The drum of claim 2 wherein each of said blocks is in a substantially unstressed condition.

4. The drum of claim 2 wherein said substantially flat planes defined by each of said two ends of said cylinder lie substantially parallel to each other and said blocks are arranged in a plurality of layers with each of said layers lying substantially parallel to said substantially flat planes.

5. The drum of claim 4 wherein the grain of the wood of each of said blocks is substantially undisturbed from its natural condition.

6. The drum of claim 5 wherein each of said blocks is formed from a single integral piece of wood.

7. The drum of claim 6 wherein the inside of said cylinder has a substantially smooth surface.

8. The drum of claim 7 wherein at least a portion of said blocks have a box joint between them at their common surfaces.

9. The drum of claim 6 wherein the grain in substantially all of said blocks lies in the plane of the layer containing the block.

10. The drum of claim 5 including a plurality of dowels each passing through a plurality of said layers in a direction substantially perpendicular to said flat planes, said dowels being spaced apart from each other around said cylinder.

11. The drum of claim 10 wherein each of said blocks is formed from a single integral piece of wood and the grain in substantially all of said blocks lies in the plane of the layer containing the block.

12. The drum of claim 11 wherein the blocks of one of said layers has a staggered orientation relative to the blocks of any adjacent layer.

13. The drum of claim 12 wherein the layers at each of said two ends has a greater thickness than the other layers in said body.

14. The drum of claim 12 wherein, on a cross-sectional plane passing transversely to said flat planes and passing through the center of said cylinder, at least one of the ends of said cylinder, passing from said surface on the inside of said cylinder toward the outside of said cylinder makes an angle of 45° relative to a normal passing through said substantially flat planes.

15. The drum of claim 14 wherein said cylinder, at said ends, defines a smaller area than the outer surface of said cylinder intermediate said ends.

16. The drum of claim 15 wherein, on said cross-sectional plane, at least one of the ends of said cylinder, passing from said surface of said cylinder on the outside toward the inside of said cylinder makes an angle of about 22° relative to said normal.

17. The drum of claim 12 wherein the faces of each of said blocks lying adjacent to other blocks in the same layer make an angle of about 22.5° relative to each other.

18. The drum of claim 12 wherein the outside surface of said cylinder is substantially straight from one of said ends to the other of said ends.

19. The drum of claim 12 wherein the outside surface of said cylinder bows outwardly in the area between said ends.

20. The drum of claim 12 wherein said blocks are adhered to each other with an adhesive.

21. The drum of claim 2 wherein:

(A) each of said blocks is formed from a single integral piece of wood;

(B) each of said blocks is in a substantially unstressed condition;

(C) said substantially flat planes defined by each of said two ends of said cylinder lie substantially parallel to each other and said blocks are arranged in a plurality of layers with each of said layers lying substantially parallel to said substantially flat planes;

(D) the grain of the wood of each of said blocks is substantially undisturbed from its natural condition and lies in the plane of the layer containing the block; and (E) said blocks are adhered to each other with an adhesive.

22. The drum of claim 21 wherein a plurality of dowels each passing through a plurality of said layers in a direction substantially perpendicular to said flat planes, said dowels being spaced apart from each other around said cylinder.

23. The drum of claim 22 wherein the outside surface of said cylinder is substantially straight from one of said ends to the other of said ends.

24. The drum of claim 22 wherein the outside surface of said cylinder bows outwardly in the area between said ends.

25. The drum of claim 22 wherein:

(A) on a cross-sectional plane passing transversely to said flat planes and passing through the center of said cylinder, at least one of the ends of said cylinder, passing from said surface on the inside of said cylinder toward the outside of said cylinder makes an angle of 45° relative to a normal passing through said substantially flat planes;

(B) on said cross-sectional plane, at least one of the ends of said cylinder, passing from said surface on the outisde of said cylinder, toward the inside of said cylinder makes an angle of about 22° relative to said normal; and (C) wherein the faces of each of said blocks lying adjacent to other blocks in the same layer make an angle of about 22.5° relative to each other.

26. A method of making a drum body comprising:

(A) adhering together a plurality of solid wood blocks having substantially flat faces to form a solid surface having the shape of a cylinder with two open ends, with each of said blocks extending from the inside to the outside of said cylinder; and (B) smoothing the outer surface of said cylinder.

27. The method of claim 26 wherein the step of adhering together said plurality of solid wood blocks is accomplished at least in part through applying an adhesive between said blocks.

28. The method of claim 27 further including the step, after said solid wood blocks are adhered together, of drilling a plurality of holes through said surface of said cylinder from one end to the other and thereafter placing dowels into said holes.

29. The method of claim 28 including, after placing said dowels into said holes, slicing said cylinder into segments along planes substantially parallel to one of said two substantially flat planes.

30. The method of claim 28 wherein said flat planes are parallel to each other and said blocks are adhered together in layers lying substantially parallel to said two flat planes and with the grain in each of said blocks substantially undisturbed from its natural condition and the grain in each of said blocks substantially parallel to said planes, and said blocks in a substantially unstressed condition.

31. The method of claim 30 wherein, prior to adhering said blocks together, two opposing end of said block are cut to have an angle, relative to each other, of about 22.5°.

32. The method of claim 31 further including, after said blocks are adhered together, removing a portion of the outer surface of said cylinder at both of said ends.

33. The method of claim 32 wherein said removed portion leaves behind an angle between said end and the remaining portion of said outer surface of about 22° relative to a normal passing through said end and further including the step of removing a portion of the inner surface of said cylinder at both of said ends, the removing of said portion leaving behind an angle between said end and the remaining portion of said inner surface of about 45° relative to said normal.

34. The method of claim 33 including adhering blocks at said ends with a greater thickness in the direction of said normal than the blocks in any of the other layers in said cylinder.

* * * * *